US008931994B2

(12) United States Patent
Creaney

(10) Patent No.: US 8,931,994 B2
(45) Date of Patent: Jan. 13, 2015

(54) LIFT ACCESSORY

(76) Inventor: Conor P. Creaney, Towson, MD (US)

( * ) Notice: Subject to any disclaimer, the term of this patent is extended or adjusted under 35 U.S.C. 154(b) by 0 days.

(21) Appl. No.: 13/595,357

(22) Filed: Aug. 27, 2012

(65) Prior Publication Data

US 2013/0048810 A1 Feb. 28, 2013

Related U.S. Application Data

(60) Provisional application No. 61/527,248, filed on Aug. 25, 2011.

(51) Int. Cl.

| | |
|---|---|
| ***E04G 21/14*** | (2006.01) |
| ***B66F 11/04*** | (2006.01) |
| ***E04G 3/32*** | (2006.01) |
| ***E04G 1/22*** | (2006.01) |
| ***E04G 5/00*** | (2006.01) |
| ***E04G 5/14*** | (2006.01) |
| *E04G 1/24* | (2006.01) |

(52) U.S. Cl.

CPC . *B66F 11/04* (2013.01); *E04G 3/32* (2013.01); *E04G 1/22* (2013.01); *E04G 5/00* (2013.01); *E04G 5/14* (2013.01); *E04G 2001/242* (2013.01)

USPC ..... 414/11; 182/141; 182/113; 248/219.2; 248/224.7

(58) Field of Classification Search

USPC ..... 248/218.4, 219.2, 224.7, 225.21, 227.4, 248/228.6, 230.6, 231.71, 214, 311.2; 182/141, 113; 414/11; 211/41.1, 41.14, 211/41.15, 50

See application file for complete search history.

(56) References Cited

U.S. PATENT DOCUMENTS

| | | | | |
|---|---|---|---|---|
| D227,091 | S | 6/1973 | Grove et al. | |
| 3,871,477 | A | 3/1975 | Kuest | |
| 4,648,617 | A * | 3/1987 | Hannappel | 280/304.3 |
| 4,741,505 | A * | 5/1988 | Anderson | 248/357 |
| 5,149,122 | A * | 9/1992 | Helber | 280/491.2 |
| 5,497,851 | A | 3/1996 | Walcher et al. | |
| 5,511,813 | A * | 4/1996 | Kravitz | 280/495 |
| 5,683,063 | A * | 11/1997 | Seiders et al. | 248/214 |
| 5,779,204 | A * | 7/1998 | Greenberg et al. | 248/205.1 |
| 6,003,629 | A * | 12/1999 | Cloutier et al. | 182/45 |
| 6,007,033 | A * | 12/1999 | Casson et al. | 248/224.7 |
| 6,302,238 | B1 * | 10/2001 | Preusser et al. | 182/150 |
| 6,511,275 | B2 * | 1/2003 | Ray | 414/11 |
| 6,742,799 | B1 * | 6/2004 | Hansen | 280/495 |
| 6,973,997 | B2 | 12/2005 | Fara | |
| 6,994,362 | B2 * | 2/2006 | Foster | 280/163 |
| 7,182,173 | B2 | 2/2007 | Bailey | |
| 7,802,708 | B2 * | 9/2010 | Adamczewski et al. | 224/543 |
| 8,025,306 | B2 * | 9/2011 | Kurzka et al. | 280/402 |
| 8,356,783 | B1 * | 1/2013 | Gilbertson et al. | 248/224.7 |
| 8,398,316 | B2 * | 3/2013 | Mota et al. | 396/427 |

(Continued)

*Primary Examiner* — Nkeisha Smith

(74) *Attorney, Agent, or Firm* — Whiteford, Taylor & Preston, LLP; Joseph L. Morales

(57) ABSTRACT

The present invention is a lift accessory for aerial lifts and related machines. The lift accessory includes sets of retractable supports for materials around the perimeter of an aerial lift platform. In a preferred embodiment, two accessories would be installed on opposite ends of the lift platform. Typically, the accessory is based upon a section of steel tubing. The inside end may be pivotally attached via a bolt or other appropriate attachment means to a railing on a work platform of the lift.

14 Claims, 8 Drawing Sheets

(56) References Cited

U.S. PATENT DOCUMENTS

2001/0037914 A1* 11/2001 Preusser et al. ..... 182/150
2002/0159863 A1* 10/2002 Ray ..... 414/11
2005/0098697 A1* 5/2005 Collins ..... 248/231.71
2009/0294215 A1 12/2009 Vos
2010/0320713 A1* 12/2010 Mann ..... 280/163
2013/0001386 A1* 1/2013 Van Wingerden et al. . 248/219.2

* cited by examiner

LIFT ACCESSORY

CROSS-REFERENCE TO RELATED APPLICATIONS

This application claims priority under 35 U.S.C. §119(e) from U.S. Provisional Patent Application Ser. No. 61/527,248, entitled "Lift Accessory" filed with the United States Patent and Trademark Office on Aug. 25, 2011, the specification of which is incorporated herein by reference in its entirety.

BACKGROUND OF THE INVENTION

1. Field of the Invention

This invention relates to equipment used in construction. Specifically, this invention relates to an accessory for a platform used for lifting workers and materials to an elevated position.

2. Description of the Background

During construction of buildings and other structures, it is often necessary to lift workers and materials to elevated levels. Lifting platforms are known in the prior art. Aerial work platform assemblies are well known devices for lifting workers or equipment to elevated work areas. In construction applications, these lifting platforms have been lifted by ground-based vehicles such as forklifts or scissor lifts.

Aerial platforms are shown, for instance, in U.S. Pat. Nos. 7,182,173 and 5,683,063. As shown, the platform includes a boom/lift and a work stand. One end of the boom is usually mounted to a vehicle or mobile chassis. The other end of the boom/lift is attached to the work stand. Typically, a controller raises the end of the boom/lift that is attached to the work stand to a desired aerial work site. The work stand includes a floor, spaced vertical bars, and horizontal rails on the top end of the vertical bars.

In some instances, the aerial work apparatus will have a material-handling device such as a winch or forklift with which to lift tools and supplies to and from an elevated work site attached at the outer end of the boom/lift. Since the choice of device attached to the boom/lift is usually permanent and not exchangeable, a separate apparatus is therefore needed for each type of lifting operation. In particular, while one aerial lift may be needed to raise material to an elevated work site, a different lift will be required to provide a working platform for those individuals needed to complete the job.

Although a certain amount of material can be carried with the workers in their aerial platform, space and safety considerations limit, in most instances, the number and size of such items. Moreover, there has been an understandable tendency to avoid placing personnel in the air with a heavy load.

To attach equipment to the work stand, poles or tubes may be secured to the vertical bars or horizontal rails with rope, vice grip chain clamps, and the like. Numerous other apparatus and equipment have also been attached to the work stand or aerial work platforms in a similar fashion using rope or vice grip chain clamps.

However, the use of rope to tie the support poles to the work stand is not very secure and can be awkward and inconvenient. In addition, attachments using ropes or the like do not always yield satisfactory results. The vice-grip chain clamps are also not very secure as a means to attach accessories to the work stand. They can become dislodged, which is unsafe to the users of the work stand or those standing or working beneath it.

SUMMARY

It is, therefore, an object of the present invention to provide a lift accessory that avoids the disadvantages of the prior art.

It is another object of the present invention to provide a lift accessory that is convenient and easy to use. A related object of the present invention is to provide a lift accessory that can be adapted for use on many lift machines.

BRIEF DESCRIPTION OF THE DRAWINGS

The above and other features, aspects, and advantages of the present invention are considered in more detail, in relation to the following description of embodiments thereof shown in the accompanying drawings, in which.

DESCRIPTION OF EXEMPLARY EMBODIMENTS

The invention summarized above may be better understood by referring to the following description, which should be read in conjunction with the accompanying claims and drawings in which like reference numbers are used for like parts. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
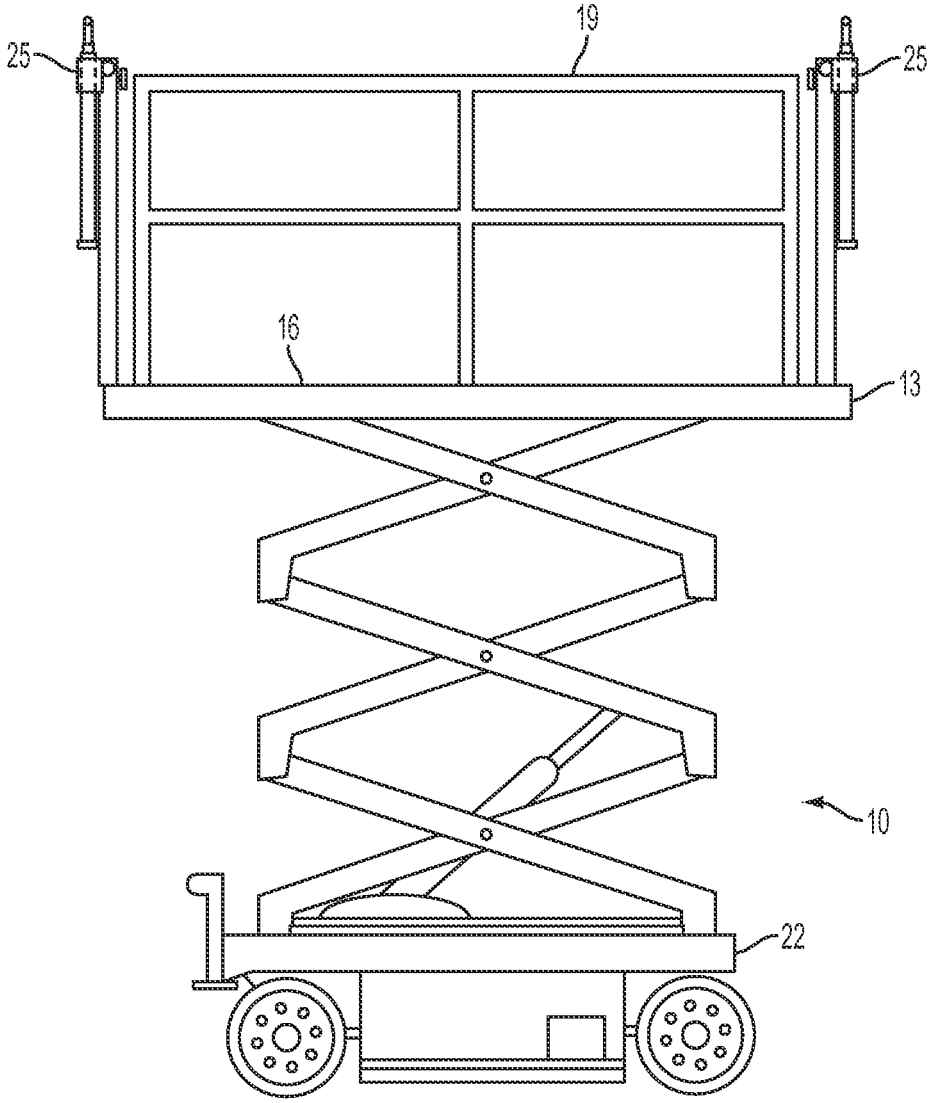
FIG. 1 shows a scissor lift having a lift accessory according to the present invention attached thereto.

Referring to the drawings, aerial lift equipment, shown generally as 10, for example, extendable boom lifts or scissor lifts that extend vertically from a mobile base, have also been used to support equipment at elevated heights. The scissor lift or extendable boom is normally mounted on a mobile chassis 22, as shown in FIG. 1. The chassis 22 facilitates movement of the scissor lift or extendable boom. The extendable boom and scissor lift have a platform 13 that typically provides support for one or more persons to perform service-type tasks. The platform 13 in scissor lifts is relatively large. In one exemplary embodiment, the platform 13 has the following dimensions: 30" by 72". The platform 13 typically comprises a frame including a floor 16 and vertically spaced tubular metal lift rails 19 interconnected to other frame members to form the structure.

Although aerial lifts are being used more frequently to carry equipment and construction components that require being elevated, present techniques for securing large pieces are less than satisfactory. Typically, conduit pipe or duct equipment are mounted on lift rails 19 and variably secured to the platform 13. The rigging of a makeshift support and then strapping a large component to this support is a very imprecise and potentially dangerous procedure. There is the danger of large and heavy, or fragile, equipment falling. Further, the safety of an operator is jeopardized in those situations where lift rails 19 may have to be removed for sufficient space. The safety of persons underneath the aerial lift is also at risk, and this may include large work crews and others.

A lift accessory 25 for aerial lifts and related machines, as described in this application, solves the problems described above. The lift accessory 25 comprises sets of retractable supports (an extension rail 40 and adjustable end stop 44) that permit attachment or placement of materials around the perimeter of an aerial lift platform 13 without reducing the usable area within the lift rails 19 of the lift platform 13. In a preferred embodiment, two lift accessories 25 would be installed on opposite ends of the lift platform 13, as shown in FIG. 1.

Figure 2:
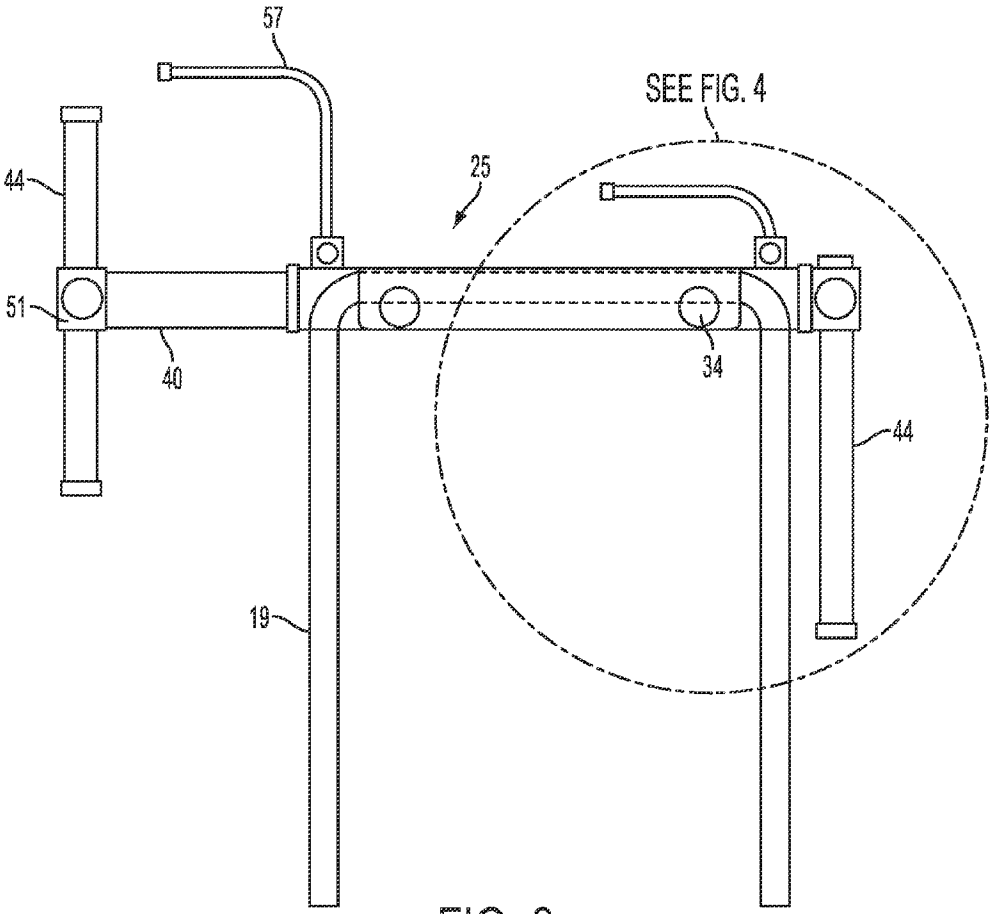
FIG. 2 shows a side view of a lift accessory according to the present invention.
Figure 4:
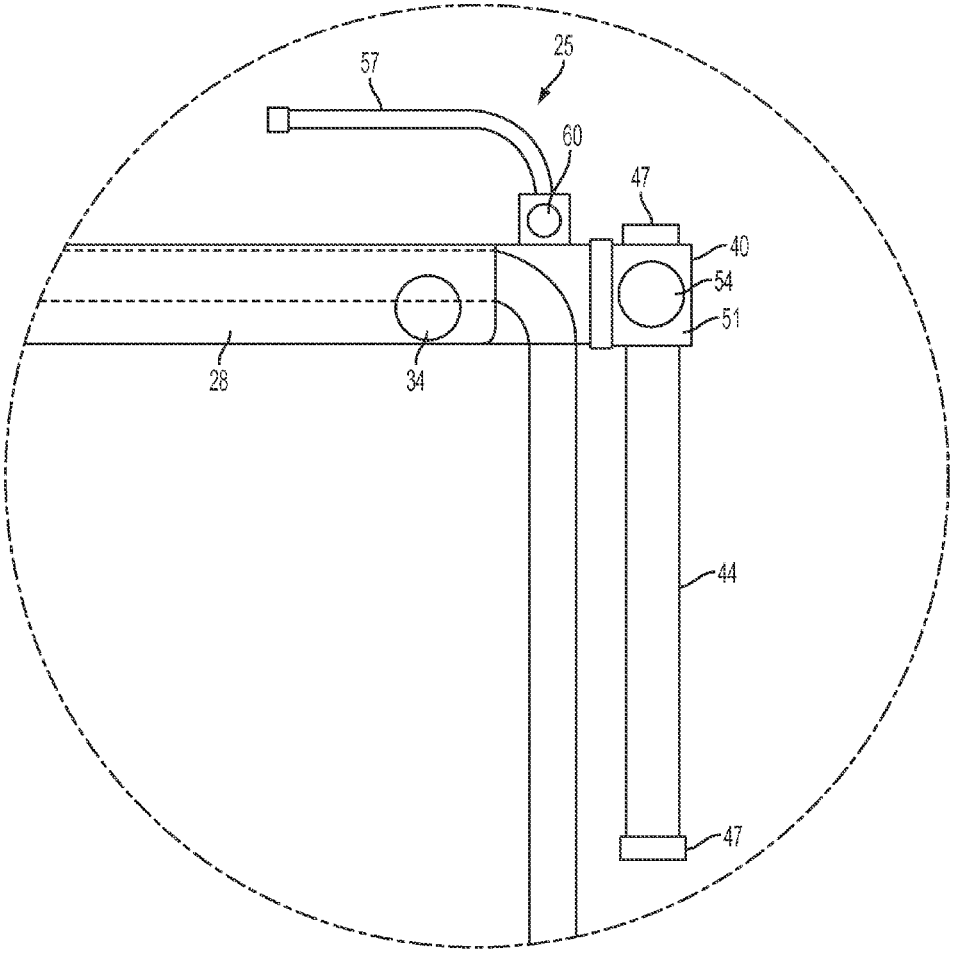
FIG. 4 shows an enlarged view of a portion of FIG. 2.
Figure 5:
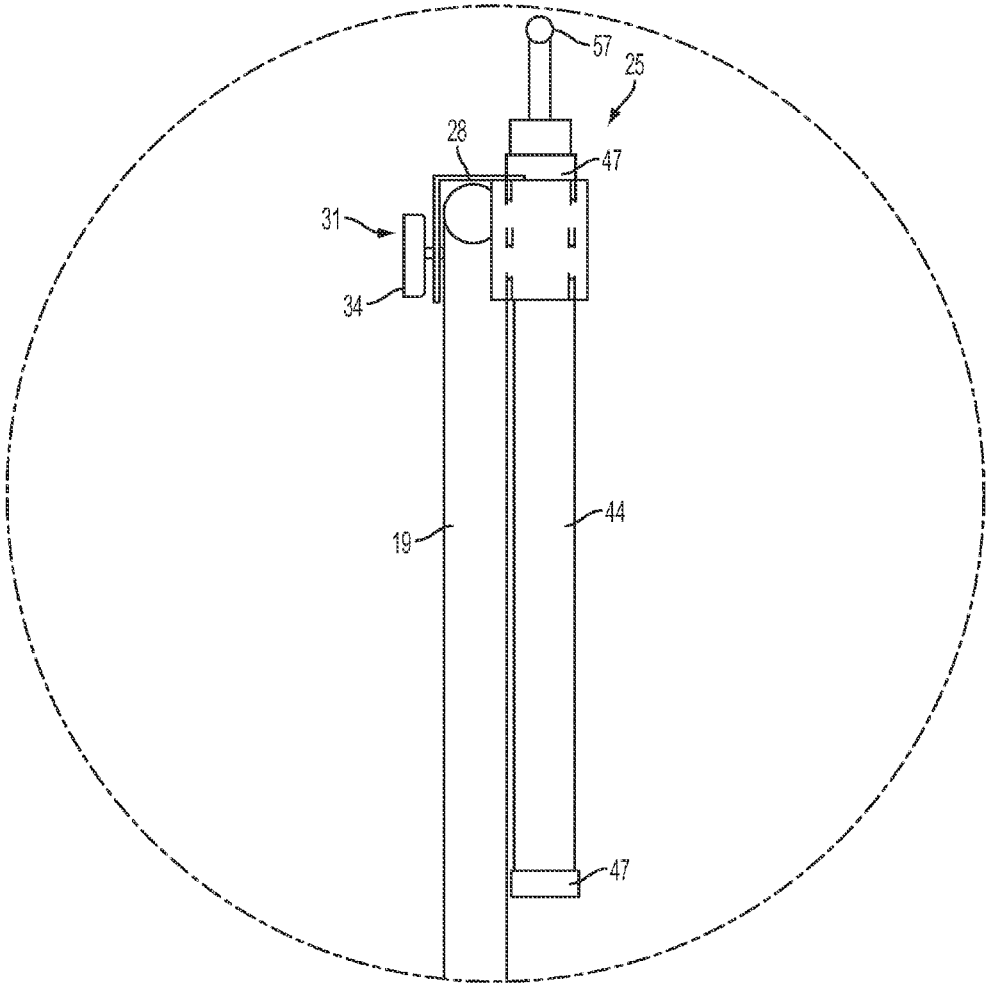
FIG. 5 shows an enlarged view of a portion of FIG. 3.

One view of the lift accessory 25 is shown in FIG. 2, a frame 79 comprising a front wall 80, rear wall 83, a top wall 86 and a bottom wall 89 connected together to form a frame channel 37. In some embodiments, the walls will form a solid cylinder, where the wall designations identify where other components are attached to the frame 79. In other embodiments, the walls from a square or rectangular structure. The frame channel 37 is configured to accept extension rails 40. In one exemplary embodiment, a first extension rail 40 is configured to fit and slide along the frame channel 37. The extension rail 40 comprises a front rail wall, rear rail wall, a top rail wall and a bottom rail wall connected together and which correspond to the walls of the frame 79.

The extension rail 40 is moveable from a fully retracted position, as shown in the right side of FIG. 2, to a fully deployed position, as shown in the left side of FIG. 2. When fully extended, the lift accessory 25 would feature an overall length of approximately 6 to 7 feet. Extension rail 40 may be based upon a section of square steel tubing with a retention device on an inner end. The extension rail 40 can be secured in its retracted or deployed positions through latches or similar fastening mechanisms. In some embodiments, a friction clamp may be used to limit the distance that the extension rail 40 is deployed.

Figure 3:
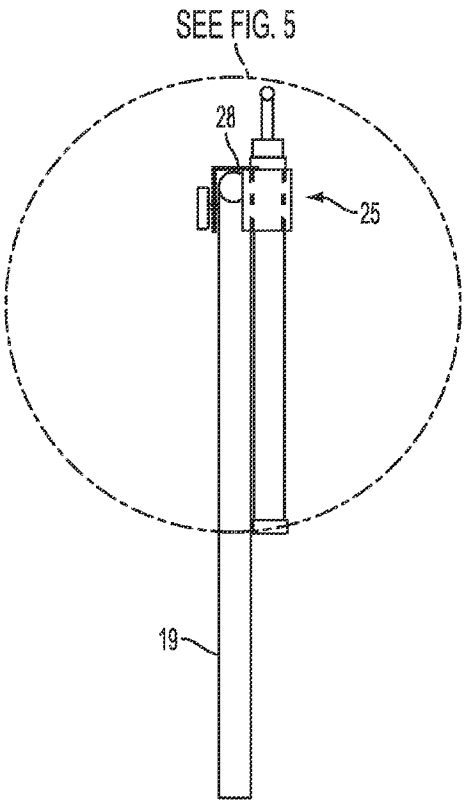
FIG. 3 shows an end view of a lift accessory according to the present invention.

As shown in FIGS. 2 and 3, the lift accessory 25 includes a mounting bracket 28, such as a U-shaped section of metal sized and configured to fit over the top of the lift rails 19. Preferably, a locking device 31 engages the railing. The locking device 31 may be tightened by manipulating a knob 34 or similar device. Other means of securing the lift accessory 25 to the lift rails 19 may be used. The locking device 31 is configured to prevent the lift accessory 25 from falling or separating from the lift rails 19.

On the distal end of the extension rail 40 is an adjustable end stop 44 having a stop piece 47 on each end. The distal end is the end of the extension rail furthest from the frame 78. In some embodiments, the end stop will only have a single stop piece 47. The stop piece 47 is an attachment for or modification of the end stop that prevents it from falling through the stop flange 51. In some embodiments, for example, the stop piece 47 refers to tapering the end of the end stop 41 to prevent it from falling through the stop flange 51. In other embodiments, the stop piece 47 is an attachment to the end stop 44, where the stop piece 47 is permanently, or removably, attached to the end stop 47 and prevents it from falling through the stop flange 51. The end stop 44 is arranged substantially perpendicular to the extension rail by stop flange 51. Stop flange 51 is rigidly attached to the extension rail 40 and permits end stop 44 to be adjustably positioned therein. A friction clamp 54 may be used to hold the end stop 44 in a desired position.

In a preferred embodiment, the lift accessory 25 may include a hold down bar 57. The hold down bar 57 may be extendable and rotatable, having a friction clamp 60 to keep the hold down bar 57 in a desired position.

In use, the lift accessory 25 may be mounted on a scissor lift 10 and can provide a means of hoisting pipes, sheets of drywall, ducts, and other materials to an elevated location. The lift accessory 25 could also be able to hold such components in position as they were installed. The lift accessory 25 would be easy to extend and retract and its sturdy construction could endow it with a good level of strength and durability. Other features of the device would be its small size, ease of use, convenience, and efficiency.

A further object of the present invention is to provide a system comprising two lift accessories 25 that are place on each side of a lift rail 19. The end stops 41 of each lift accessory on opposite sides of the lift rail 19 allow the individual using the lift to hold materials on the outside of the lift platform 13. In another embodiment, a kit is provided that comprises the various components of the lift accessory. Preferably, the kit would comprise sufficient components for at least two lift accessories to be placed on a lift platform 13.

Figure 6:
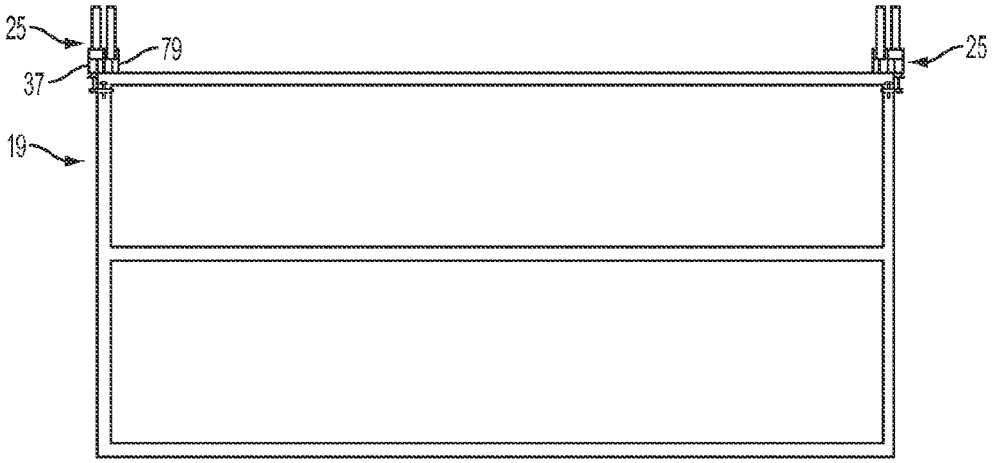
FIG. 6 shows a front view of a lift platform with two lift accessories attached to the rails according to the present invention.

FIG. 6 shows another embodiment of the present invention in which two lift accessories 25 are attached to the lift rails 19. The lift accessories of FIG. 6 have a frame 79 with two frame channels 37 that allow the extension rails 40 to be extended next to each other. Having two parallel channels provides sufficient space for the extension rails to achieve additional extension lengths. It is contemplated that the extension rails 40 can be configured in many different ways that maximize the extension of the extension rails 40. For example, the extension rails 40 may fit within each other to allow additional extension rail 40 lengths.

Figure 7:
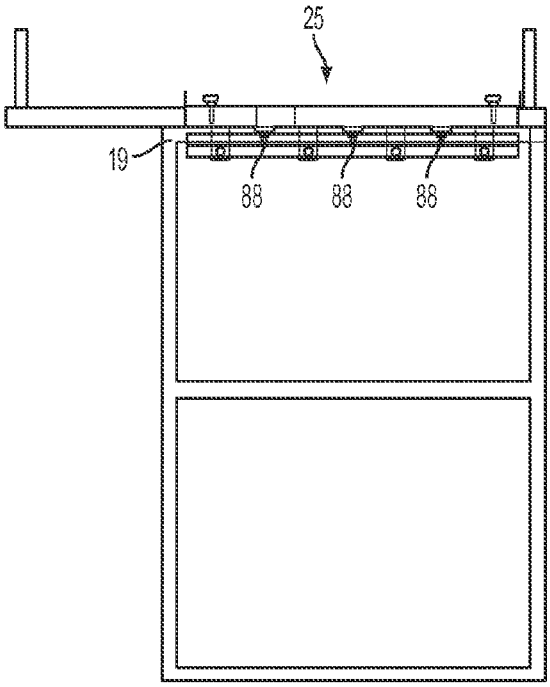
FIG. 7 is a side view of a lift accessory installed on a rail according to the present invention.
Figure 8A:
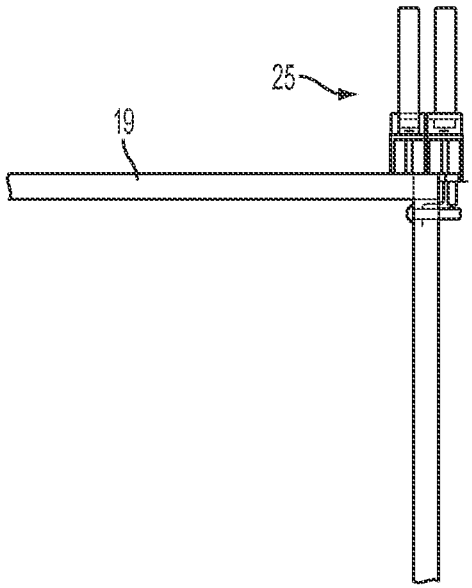
FIGS. 8A and 8B show an expanded view of a lift accessory installed on a rail according to the present invention.
Figure 8B:
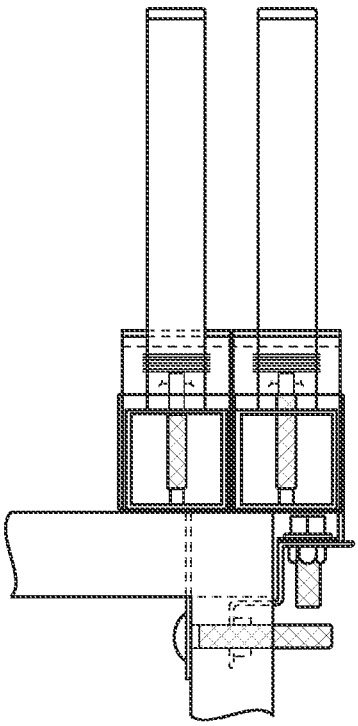

As shown on FIG. 7, the lift accessory 25 can be attached to the lift rail 19 in various different ways. In one example, the lift accessory 25 is bolted to the lift rail 19 through the use of bolts that extend through the lift rail 19. FIGS. 8A and 8B show yet another embodiment of the present invention where the lift accessory 25 is secured by a bracket that fits the lift rail 19.

Figure 9:
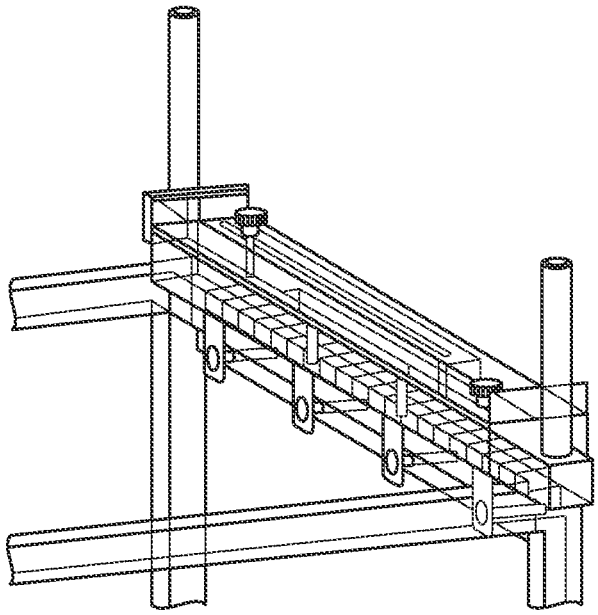
FIG. 9 is a perspective view of an embodiment of the present invention.
Figure 10:
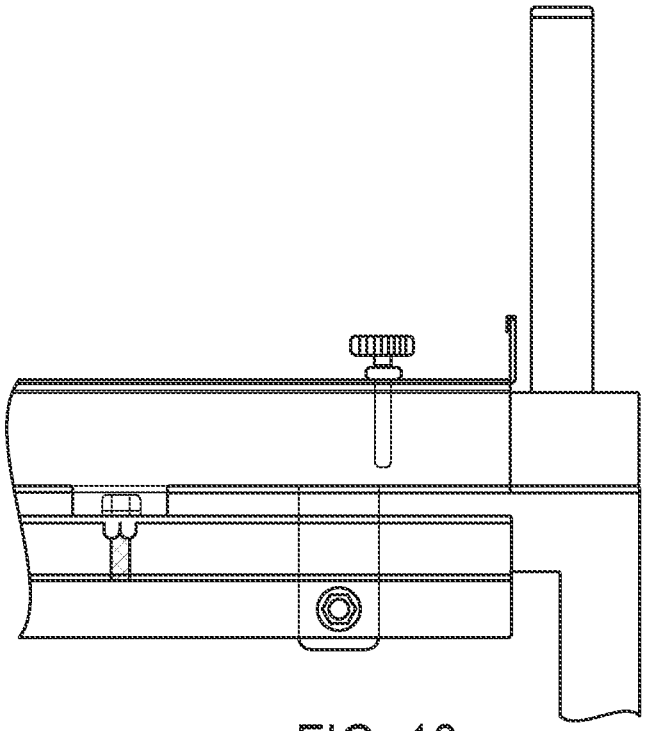
FIG. 10 shows an expanded front view of the lift accessory attached to a rail according to the present invention.

FIG. 9 shows a perspective view of one embodiment of the present invention, in which the extension rails 40 are shown on a side by side configuration. The side-by-side configuration, as explained above, allow the extension rails 40 to have a greater extension length. FIG. 10 shows an expanded frontal view of the lift assembly 25 attached to the rail 19.

Figure 11A:
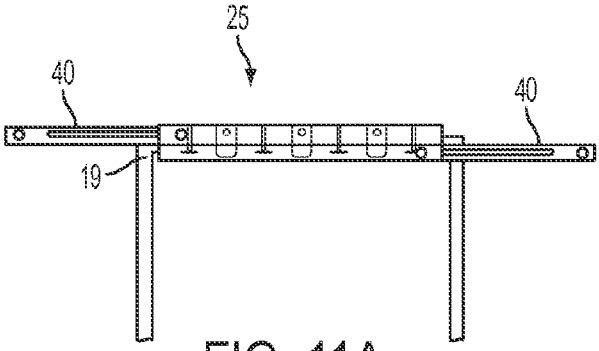
FIGS. 11A and 11B are a top view of one embodiment of the present invention.
Figure 11B:
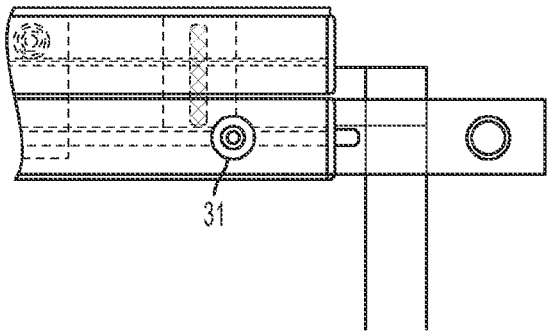
Figure 12:
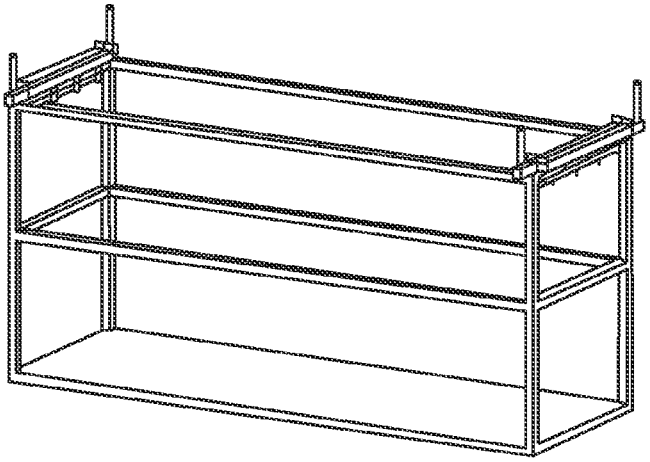
FIG. 12 is a perspective view of the lift accessories attached to a rail on a lift platform according to the present invention.

On FIG. 11A, the extension rails 40 are shown in their extended position. As shown, the extension rails 40 have an extension channel that allows for control of the extension rail length. Utilizing a fastening mechanism, such as a bolt, the extension rails 40 can be locked in place. As shown in FIG. 11B, which is an expanded view of one side of the lift assembly 25, the locking device 31 connects with the extension channel and controls the length of the extension rail 40.

It will be appreciated by persons skilled in the art that numerous variations and/or modifications may be made to the invention as shown in the specific embodiments without departing from the spirit or scope of the invention as broadly described. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention might be practiced otherwise than as specifically set forth herein. The present embodiments are, therefore, to be considered in all respects as illustrative and not restrictive.

What is claimed is:

1. An apparatus, comprising:

a horizontal frame comprising a front wall, a rear wall, a top wall and a bottom wall connected together to form a frame channel;

a first extension rail configured to fit and slide along the frame channel, wherein the extension rail comprises a front rail wall, a rear rail wall, a top rail wall and a bottom rail wall connected together, a stop flange and an end stop that slides through the stop flange at the extension rail's distal end, wherein the end stop extends vertically away from said first extension rail a second extension rail configured to fit and slide along the frame channel, wherein the second extension rail comprises a front rail wall, a rear rail wall, a top rail wall and a bottom rail wall connected together, and an end stop at a second extension rail's distal end;

a hold down bar attached to a distal end of the top wall of said horizontal frame; and a mounting bracket on the rear wall of the frame, wherein said mounting bracket extends away from said horizontal frame forming a channel parallel to the horizontal frame.

2. The apparatus of claim 1, wherein the mounting bracket comprises a first side and a second side perpendicular to one another.

3. The apparatus of claim 1, wherein the mounting bracket further comprises a locking device.

4. The apparatus of claim 1, wherein the first and second extension rails are; secured to the frame by a retention device.

5. The apparatus of claim 1, wherein the first and second extension rails each comprise; a fastener to lock them into position.

6. The apparatus of claim 1, further comprising a friction clamp for controlling displacement of the first and second extension rails.

7. The apparatus of claim 1, wherein the end stop of the second extension rail slides through a stop flange and; wherein the stop flanges of the first and second extension rails provide; resistance for each of the end stops.

8. The apparatus of claim 7, further comprising a friction clamp at the distal end of each of the first and second extension rails; to control displacement of the end stops.

9. The apparatus of claim 8, wherein the end stops of the first and second extension rails each comprise; a stop piece at one or both ends of each of said end stops.

10. The apparatus of claim 1, wherein the hold down bar attached to the frame comprises a vertical segment and a horizontal segment perpendicular to the vertical segment.

11. The apparatus of claim 10, wherein the hold down bar is rotatable, extendable, or both.

12. The apparatus of claim 10, further comprising a friction clamp connected to the hold down bar.

13. The apparatus of claim 1, wherein the frame channel is configured to accept the first and second extension rails next to each other.

14. The apparatus of claim 13, wherein the front rail wall of the first extension rail is parallel and adjacent to the front wall to of the horizontal frame and the rear rail wall of the second extension rail is parallel and adjacent to the rear wall of the horizontal frame and wherein the rear rail wall of the first extension rail is parallel and adjacent to the front rail wall of the second extension rail.

* * * * *